US006261729B1

(12) United States Patent
Yuh et al.

(10) Patent No.: US 6,261,729 B1
(45) Date of Patent: Jul. 17, 2001

(54) BLOCKING LAYER WITH LINEAR PHENOLIC RESIN

(75) Inventors: Huoy-Jen Yuh, Pittsford; Zhilei Wang, Penfield; Daniel G. Hullihen, Jr., Avon; John S. Chambers, Rochester; Harold F. Hammond, Webster, all of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/544,687

(22) Filed: Apr. 7, 2000

(51) Int. Cl.[7] ..... G03G 5/14
(52) U.S. Cl. ..... 430/65; 430/64
(58) Field of Search ..... 430/65, 64

(56) References Cited

U.S. PATENT DOCUMENTS

| | | | |
|---|---|---|---|
| 4,579,801 | 4/1986 | Yashiki | 430/60 |
| 5,489,496 | 2/1996 | Katayama et al. | 430/62 |
| 5,561,022 * | 10/1996 | Nogami et al. | 430/131 |
| 5,965,311 | 10/1999 | Suzuki | 430/60 |
| 6,177,219 | 1/2001 | Yuh et al. | 430/65 |

OTHER PUBLICATIONS

OxyChem Material Safety Data Sheet for VARCUM 29112, Jan. 2000.*

Brady, James E. et al. General Chemistry, Third Edition. New York: John Wiley & Sons. p. 43, 1982.*

Alger, Mark. Polymer Science Dictionary. London: Elsevier Applied Science. "Resole", pp. 415–416, 1990.*

* cited by examiner

*Primary Examiner*—Christopher Rodee
(74) *Attorney, Agent, or Firm*—Zosan S. Soong

(57) ABSTRACT

A photoreceptor including: (a) a substrate; (b) a charge blocking layer including n-type particles and a linear phenolic binder composition; and (c) an imaging layer.

14 Claims, 3 Drawing Sheets

BLOCKING LAYER WITH LINEAR PHENOLIC RESIN

FIELD OF THE INVENTION

This invention relates to a photoreceptor useful for an electrostatographic printing machine, and particularly to an improved charge blocking layer.

BACKGROUND OF THE INVENTION

The demand for improved print quality in xerographic reproduction is increasing, especially with the advent of color. Some of the print quality issues such as the defect level of the charge deficient spots ("CDS") and the print defects caused by bias charge roll ("BCR") leakage, are strongly dependent on the quality of the charge blocking layer. Conventional materials used for the blocking layer have been problematic. In certain situations, a thicker blocking layer is desirable, but the thickness of the material used for the blocking layer is limited by the inefficient transport of the photoinjected electrons from the generator layer to the substrate. Another problem is posed by a blocking layer that is too thin: incomplete coverage of the substrate due to wetting problems on localized unclean substrate surface areas. These pin holes can then produce CDS and BCR leakage breakdown. A thicker blocking layer can be produced by dispersing titanium dioxide particles into a binder, which can allow the transport of photogenerated electrons and may eliminate any pin holes due to incomplete coverage. In certain situations, a high concentration of titanium dioxide in the blocking layer is desirable. However, the dispersion quality such as particle size distribution may be significantly worse at a high titanium dioxide concentration. Poor dispersions often cause coating defects such as streak and coating non-uniformity. The dispersion quality of titanium dioxide depends on the binder and solvent employed. Conventional binders and solvents may be unsuitable at a high concentration of the titanium dioxide. In addition, some conventional binders are soluble in the solutions coated onto the substrate after the blocking layer such as the solutions for the charge generating layer and the charge transport layer. Such a solubility allows intermixing of layers that results in electrical and print quality problems. Thus, there is a need, which the present invention addresses, for new binders for the blocking layer of a photoreceptor that minimize or eliminate the problems of conventional binders described herein.

The phrases "charge blocking layer" and "blocking layer" are generally used interchangeably with the phrase "undercoat layer."

Yashiki, U.S. Pat. No. 4,579,801 discloses an electrophotographic photosensitive member having a phenolic resin layer formed from a resol coat, between a substrate and a photosensitive layer.

Conventional photoreceptors and their materials are also dislosed in Katayama et al., U.S. Pat. No. 5,489,496; and Suzuki, U.S. Pat. No. 5,965,311.

Huoy-Jen Yuh et al., U.S. application Ser. No. 09/416,840, discloses a charge blocking layer including a binder, a plurality of grain shaped n-type particles and a plurality of needle shaped n-type particles.

SUMMARY OF THE INVENTION

The present invention is accomplished in embodiments by providing a photoreceptor comprising:

(a) a substrate;

(b) a charge blocking layer including n-type particles and a phenolic binder composition including:

(i) a first type of repeat unit selected from the group consisting of the following three subtypes:

(1)

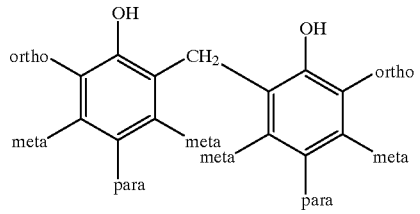

(2)

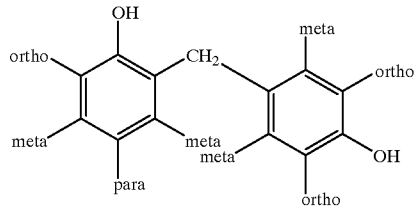

(3)

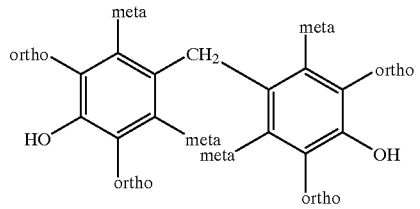

(ii) a second type of repeat unit of:

(4)

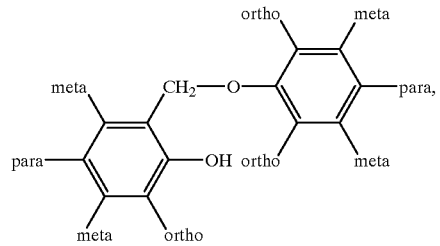

and (iii) a third type of repeat unit selected from the group consisting of the following two subtypes:

(5)

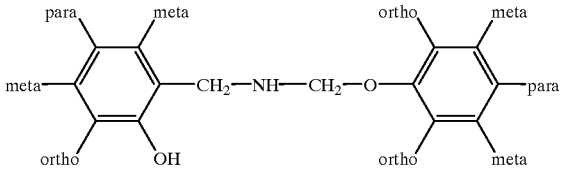

(6)

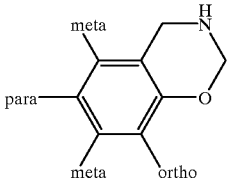

wherein the first repeat unit, the second repeat unit, and the third repeat unit all are present in the phenolic binder composition to form polymers including homopolymers of one type of repeat unit, copolymers of any two types of repeat units, or terpolymers of all three types of repeat units, or a mixture of any combination of the homopolymers the copolymers, and the terpolymers, wherein the first repeat unit, the second repeat unit, and the third repeat unit form the polymers via linkage groups coupled to any of the ortho and para carbon atoms; wherein any combination of the three subtypes of the first repeat unit and a mixture of the two subtypes of the third repeat unit optionally are present in the homopolymers, the copolymers, and the terpolymers;

wherein at least one alkyl group having from 1 to 20 carbon atoms is optionally coupled to any of the ortho, meta, and para carbon atoms of the first repeat unit, the second repeat unit, and the third repeat unit which are not coupled to the linkage groups; and (c) an imaging layer.

BRIEF DESCRIPTION OF THE DRAWINGS

Other aspects of the present invention will become apparent as the following description proceeds and upon reference to the Figures which represent preferred embodiments.

Unless otherwise noted, the same reference numeral in different Figures refers to the same or similar feature.

DETAILED DESCRIPTION

Figure 1:
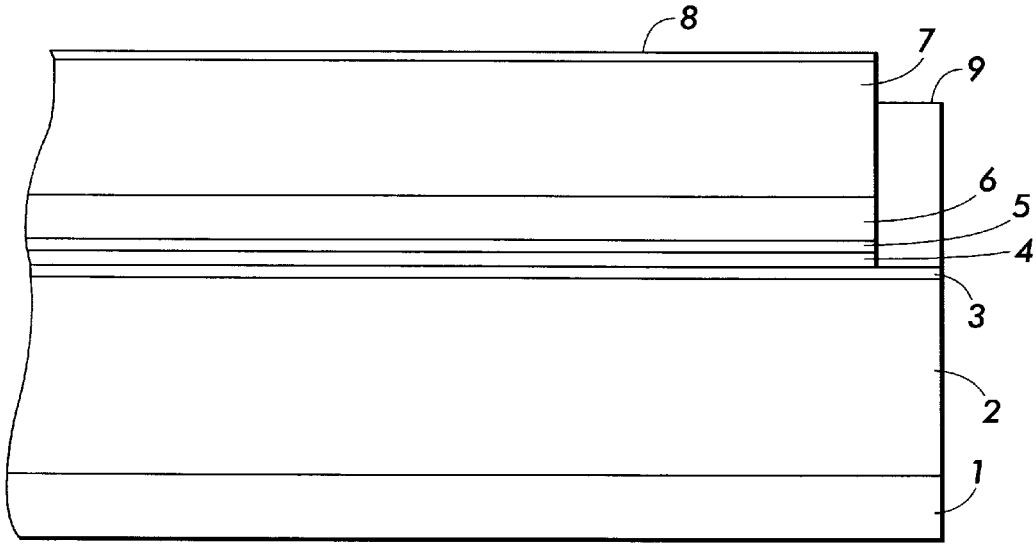
FIG. 1 represents a simplified side view of a first embodiment of the inventive photoreceptor.
Figure 2:
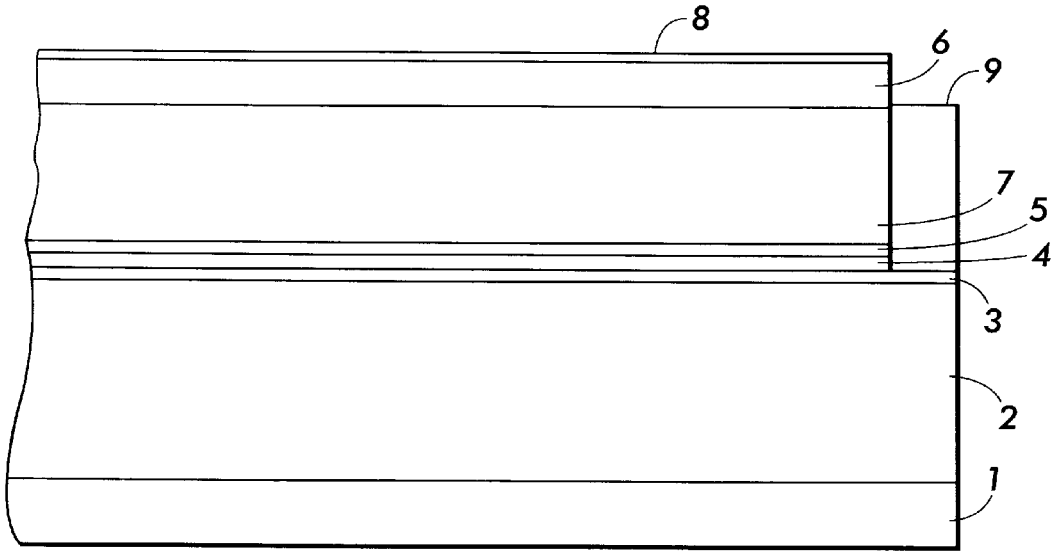
FIG. 2 represents a simplified side view of a second embodiment of the inventive photoreceptor.
Figure 3:
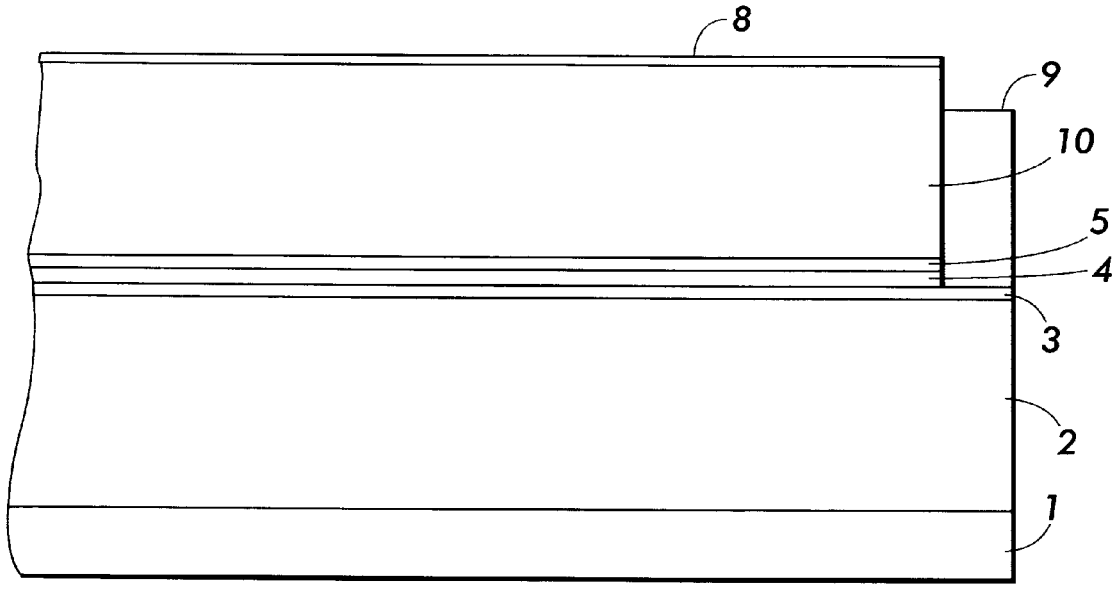
FIG. 3 represents a simplified side view of a third embodiment of the inventive photoreceptor.

Representative structures of an electrophotographic imaging member (e.g., a photoreceptor) are shown in FIGS. 1–3. These imaging members are provided with an anti-curl layer 1, a supporting substrate 2, an electrically conductive ground plane 3, a charge blocking layer 4, an adhesive layer 5, a charge generating layer 6, a charge transport layer 7, an overcoating layer 8, and a ground strip 9. In FIG. 3, imaging layer 10 (containing both charge generating material and charge transport material) takes the place of separate charge generating layer 6 and charge transport layer 7.

As seen in the figures, in fabricating a photoreceptor, a charge generating material (CGM) and a charge transport material (CTM) may be deposited onto the substrate surface either in a laminate type configuration where the CGM and CTM are in different layers (e.g., FIGS. 1 and 2) or in a single layer configuration where the CGM and CTM are in the same layer (e.g., FIG. 3) along with a binder resin. The photoreceptors embodying the present invention can be prepared by applying over the electrically conductive layer the charge generation layer 6 and, optionally, a charge transport layer 7. In embodiments, the charge generation layer and, when present, the charge transport layer, may be applied in either order.

The Anti-Curl Layer

For some applications, an optional anti-curl layer 1 can be provided, which comprises film-forming organic or inorganic polymers that are electrically insulating or slightly semi-conductive. The anti-curl layer provides flatness and/or abrasion resistance.

Anti-curl layer 1 can be formed at the back side of the substrate 2, opposite the imaging layers. The anti-curl layer may include, in addition to the film-forming resin, an adhesion promoter polyester additive. Examples of film-forming resins useful as the anti-curl layer include, but are not limited to, polyacrylate, polystyrene, poly(4,4'-isopropylidene diphenylcarbonate), poly(4,4'-cyclohexylidene diphenylcarbonate), mixtures thereof and the like.

Additives may be present in the anti-curl layer in the range of about 0.5 to about 40 weight percent of the anti-curl layer. Preferred additives include organic and inorganic particles which can further improve the wear resistance and/or provide charge relaxation property. Preferred organic particles include Teflon powder, carbon black, and graphite particles. Preferred inorganic particles include insulating and semiconducting metal oxide particles such as silica, zinc oxide, tin oxide and the like. Another semiconducting additive is the oxidized oligomer salts as described in U.S. Pat. No. 5,853,906. The preferred oligomer salts are oxidized N, N, N', N'-tetra-p-tolyl-4,4'-biphenyldiamine salt.

Typical adhesion promoters useful as additives include, but are not limited to, duPont 49,000 (duPont), Vitel PE-100, Vitel PE-200, Vitel PE-307 (Goodyear), mixtures thereof and the like. Usually from about 1 to about 15 weight percent adhesion promoter is selected for film-forming resin addition, based on the weight of the film-forming resin.

The thickness of the anti-curl layer is typically from about 3 micrometers to about 35 micrometers and, preferably, about 14 micrometers. However, thicknesses outside these ranges can be used.

The anti-curl coating can be applied as a solution prepared by dissolving the film-forming resin and the adhesion promoter in a solvent such as methylene chloride. The solution may be applied to the rear surface of the supporting substrate (the side opposite the imaging layers) of the photoreceptor device, for example, by web coating or by other methods known in the art. Coating of the overcoat layer and the anti-curl layer can be accomplished simultaneously by web coating onto a multilayer photoreceptor comprising a charge transport layer, charge generation layer, adhesive layer, blocking layer, ground plane and substrate. The wet film coating is then dried to produce the anti-curl layer 1.

The Supporting Substrate

As indicated above, the photoreceptors are prepared by first providing a substrate 2, i.e., a support. The substrate can be opaque or substantially transparent and can comprise any of numerous suitable materials having given required mechanical properties.

The substrate can comprise a layer of electrically non-conductive material or a layer of electrically conductive material, such as an inorganic or organic composition. If a non-conductive material is employed, it is necessary to provide an electrically conductive ground plane over such non-conductive material. If a conductive material is used as the substrate, a separate ground plane layer may not be necessary.

The substrate can be flexible or rigid and can have any of a number of different configurations, such as, for example, a sheet, a scroll, an endless flexible belt, a web, a cylinder, and the like. The photoreceptor may be coated on a rigid, opaque, conducting substrate, such as an aluminum drum.

Various resins can be used as electrically non-conducting materials, including, but not limited to, polyesters, polycarbonates, polyamides, polyurethanes, and the like.

Such a substrate preferably comprises a commercially available biaxially oriented polyester known as MYLAR™, available from E. I. duPont de Nemours & Co., MELINEX™, available from ICI Americas Inc., or HOSTAPHAN™, available from American Hoechst Corporation. Other materials of which the substrate may be comprised include polymeric materials, such as polyvinyl fluoride, available as TEDLAR™ from E. I. duPont de Nemours & Co., polyethylene and polypropylene, available as MARLEX™ from Phillips Petroleum Company, polyphenylene sulfide, RYTON™ available from Phillips Petroleum Company, and polyimides, available as KAPTON™ from E. I. duPont de Nemours & Co. The photoreceptor can also be coated on an insulating plastic drum, provided a conducting ground plane has previously been coated on its surface, as described above. Such substrates can either be seamed or seamless.

When a conductive substrate is employed, any suitable conductive material can be used. For example, the conductive material can include, but is not limited to, metal flakes, powders or fibers, such as aluminum, titanium, nickel, chromium, brass, gold, stainless steel, carbon black, graphite, or the like, in a binder resin including metal oxides, sulfides, silicides, quaternary ammonium salt compositions, conductive polymers such as polyacetylene or its pyrolysis and molecular doped products, charge transfer complexes, and polyphenyl silane and molecular doped products from polyphenyl silane. A conducting plastic drum can be used, as well as the preferred conducting metal drum made from a material such as aluminum.

The preferred thickness of the substrate depends on numerous factors, including the required mechanical performance and economic considerations. The thickness of the substrate is typically within a range of from about 65 micrometers to about 150 micrometers, and preferably is from about 75 micrometers to about 125 micrometers for optimum flexibility and minimum induced surface bending stress when cycled around small diameter rollers, e.g., 19 mm diameter rollers. The substrate for a flexible belt can be of substantial thickness, for example, over 200 micrometers, or of minimum thickness, for example, less than 50 micrometers, provided there are no adverse effects on the final photoconductive device. Where a drum is used, the thickness should be sufficient to provide the necessary rigidity. This is usually about 1-6 mm.

The surface of the substrate to which a layer is to be applied is preferably cleaned to promote greater adhesion of such a layer. Cleaning can be effected, for example, by exposing the surface of the substrate layer to plasma discharge, ion bombardment, and the like. Other methods, such as solvent cleaning, can be used.

Regardless of any technique employed to form a metal layer, a thin layer of metal oxide generally forms on the outer surface of most metals upon exposure to air. Thus, when other layers overlying the metal layer are characterized as "contiguous" layers, it is intended that these overlying contiguous layers may, in fact, contact a thin metal oxide layer that has formed on the outer surface of the oxidizable metal layer.

The Electrically Conductive Ground Plane

As stated above, photoreceptors prepared in accordance with the present invention comprise a substrate that is either electrically conductive or electrically non-conductive. When a non-conductive substrate is employed, an electrically conductive ground plane 3 must be employed, and the ground plane acts as the conductive layer. When a conductive substrate is employed, the substrate can act as the conductive layer, although a conductive ground plane may also be provided.

If an electrically conductive ground plane is used, it is positioned over the substrate. Suitable materials for the electrically conductive ground plane include, but are not limited to, aluminum, zirconium, niobium, tantalum, vanadium, hafnium, titanium, nickel, stainless steel, chromium, tungsten, molybdenum, copper, and the like, and mixtures and alloys thereof. In embodiments, aluminum, titanium, and zirconium are preferred.

The ground plane can be applied by known coating techniques, such as solution coating, vapor deposition, and sputtering. A preferred method of applying an electrically conductive ground plane is by vacuum deposition. Other suitable methods can also be used.

Preferred thicknesses of the ground plane are within a substantially wide range, depending on the optical transparency and flexibility desired for the electrophotoconductive member. Accordingly, for a flexible photoresponsive imaging device, the thickness of the conductive layer is preferably between about 20 angstroms and about 750 angstroms; more preferably, from about 50 angstroms to about 200 angstroms for an optimum combination of electrical conductivity, flexibility, and light transmission. However, the ground plane can, if desired, be opaque.

The Charge Blocking Layer

After deposition of any electrically conductive ground plane layer, a charge blocking layer 4 can be applied thereto. Electron blocking layers for positively charged photoreceptors permit holes from the imaging surface of the photoreceptor to migrate toward the conductive layer. For negatively charged photoreceptors, any suitable hole blocking layer capable of forming a barrier to prevent hole injection from the conductive layer to the opposite photoconductive layer can be utilized.

A blocking layer is preferably positioned over the electrically conductive layer. The term "over," as used herein in connection with many different types of layers, should be understood as not being limited to instances wherein the layers are contiguous. Rather, the term refers to relative placement of the layers and encompasses the inclusion of unspecified intermediate layers.

The blocking layer 4 includes n-type particles and a phenolic binder composition. The phenolic binder composition includes a linear polymer having the structure described herein, preferably a random linear polymer. A linear polymer has little if any branching of the polymer backbone, whereas a non-linear polymer has more extensive branching of the polymer backbone.

The phenolic binder composition employed in the present invention includes:

(i) a first type of repeat unit selected from the group consisting of the following three subtypes:

(1)

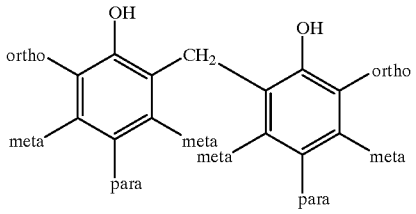

(2)

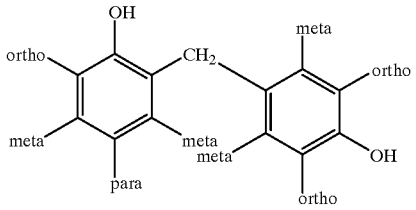

(3)

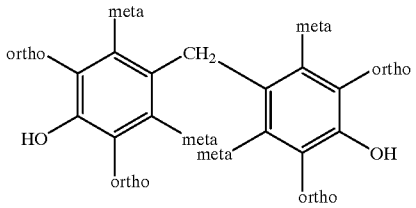

(ii) a second type of repeat unit of:

(4)

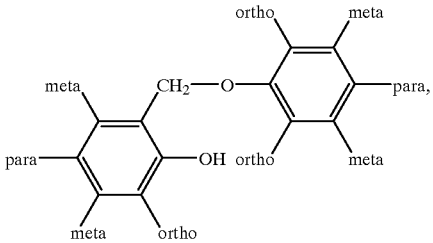

and (iii) a third type of repeat unit selected from the group consisting of the following two subtypes:

(5)

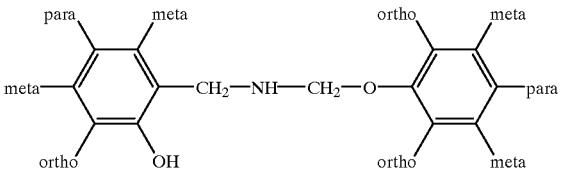

(6)

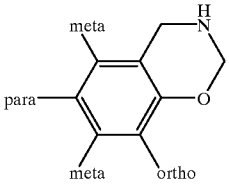

wherein the first repeat unit, the second repeat unit, and the third repeat unit all are present in the phenolic binder composition to form polymers including homopolymers of one type of repeat unit, copolymers of any two types of repeat units, or terpolymers of all three types of repeat units, or a mixture of any combination of the homopolymers the copolymers, and the terpolymers. Some or all of the homopolymers the copolymers, and the terpolymers may be linear. Any combination of the three subtypes of the first repeat unit and a mixture of the two subtypes of the third repeat unit optionally may be present in the homopolymers, the copolymers, and the terpolymers.

The first repeat unit, the second repeat unit, and the third repeat unit form the polymers via linkage groups coupled to any of the ortho and para carbon atoms. Preferably, the linkage groups are selected from the group consisting of $CH_2$ and $OCH_2$.

At least one alkyl group having from 1 to 20 carbon atoms is optionally coupled to any of the ortho, meta, and para carbon atoms of the first repeat unit, the second repeat unit, and the third repeat unit which are not coupled to the linkage groups. In embodiments, the alkyl group has from 1 to 5 carbon atoms such as methyl, ethyl, t-butyl, propyl, and 2-propyl. In certain embodiments, the alkyl group is absent from any one, two, or all of the first repeat unit, the second repeat unit, and the third repeat unit.

Preferably, the first repeat unit is present in an amount ranging from about 25 to about 60 mole percent, the second repeat unit is present in an amount ranging from about 10 to about 50 mole percent, and the third repeat unit is present in an amount ranging from about 10 to about 15 mole percent, based on the phenolic binder composition. The combined mole percentages of the first repeat unit, the second repeat unit, and the third repeat unit preferably totals at least about 70%.

A preferred phenolic binder composition including a linear polymer or linear polymers is VARCUM® 29112 available from OxyChem which is believed to have the following characteristics:

(A) The first repeat unit described herein is present in an amount ranging from about 40 to about 50 percent, calculated relative to the number of starting monomers, wherein subtypes (1), (2), and (3) are in an approximate ratio of 1:1:1.5;

(B) The second repeat unit described herein is present in an amount ranging from about 10 to about 20 percent, calculated relative to the number of starting monomers;

(C) The third repeat unit described herein is present in an amount ranging from about 10 to about 15 percent, calculated relative to the number of starting monomers, with up to about half of the third repeat unit in certain embodiments being subtype (6);

(D) About 20 to about 30 percent of the binder composition could not be determined, calculated relative to the number of starting monomers;

(E) The linkage groups are $CH_2$ and/or $OCH_2$; and (F) Other than any linkage groups, no alkyl groups are coupled to any of the ortho, meta, and para carbon atoms in the three types of repeat units.

A polymerization process to prepare VARCUM® 29112 is believed to involve prepolymers crosslinked with hexamethylenetetramine. The starting monomers are believed to be:

(7)

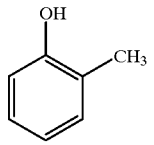

(unknown mole percent), and (8)

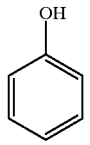

(unknown mole percent).

Another preferred phenolic binder composition including a linear polymer or linear polymers is DURITE® ESD-556C which is believed to have the following characteristics:

(A) The first repeat unit described herein is present in an amount of about 30 percent, calculated relative to the number of starting monomers;

(B) The second repeat unit described herein is present in an amount of about 50 percent, calculated relative to the number of starting monomers;

(C) The third repeat unit described herein is present in an amount of about 10 percent, calculated relative to the number of starting monomers, with up to half of the third repeat unit in certain embodiments being subtype (6);

(D) About 10 percent of the binder composition could not be determined, calculated relative to the number of starting monomers;

(E) The linkage groups are $CH_2$ and/or $OCH_2$; and (F) Other than any linkage groups, no alkyl groups are coupled to any of the ortho, meta, and para carbon atoms in the three types of repeat units.

A polymerization process to prepare DURITE® ESD-556C is believed to involve prepolymers reacted with hexamethylenetetramine. The starting monomers are believed to be:

(8)

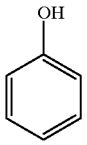

(unknown mole percent), and (9)

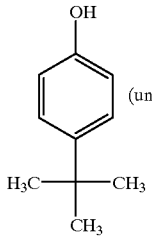

(unknown mole percent).

The composition and manner of preparation of DURITE® P97 are believed to be the same as or similar to DURITE® ESD-556C.

The blocking layer 4 should be continuous and can have a thickness ranging for example from about 0.01 to about 10 micrometers, preferably from about 0.05 to about 5 micrometers.

The blocking layer 4 can be applied by any suitable technique, such as spraying, dip coating, draw bar coating, gravure coating, silk screening, air knife coating, reverse roll coating, vacuum deposition, chemical treatment, and the like. For convenience in obtaining thin layers, the blocking layer is preferably applied in the form of a dilute solution, with the solvent being removed after deposition of the coating by conventional techniques, such as by vacuum, heating, and the like. Generally, a weight ratio of blocking layer material and solvent of between about 0.5:100 to about 30:100 is satisfactory for spray and dip coating.

The present invention further provides a method for forming the electrophotographic photoreceptor, in which the charge blocking layer is formed by using a coating solution composed of the n-type particles, the binder resin and an organic solvent.

In this invention, the n-type particles are dispersed in linear phenolic resin in an organic solvent such as an aromatic hydrocarbon-alcohol mixture within the range of about 80/20 to about 20/80 weight ratio. The aromatic hydrocarbon may be xylene or toluene. The alcohol is preferably a low alcohol solvent (that is, having from one to five carbon atoms) such as methanol, ethanol, butanol, or mixtures thereof. A mixture of xylene, toluene, and an alcohol solvent such as butanol can also be used for this application. When the dispersion is coated from a mixture of xylene and butanol, the coated film is very uniformly transparent. The thickness of the dried film is also very uniform, with 5% variation. The print quality is the gray area is very uniform.

A mixture of ethylene glycol ether or ethylene glycol ester with alcohol is not a preferred solvent for this application, due to non-uniform solvent evaporation during the drying of the coated film. Such a non-uniform drying produces uneven thickness of the coated layer and uneven hazy coatings on certain parts of the coated film. Such a non-uniformity, either in thickness or transparency, can be printed out as print density variation in the gray area in the prints.

The charge blocking layer is formed by dispersing the binder resin and the n-type particles in the solvent to form a coating solution for the blocking layer; coating the conductive support with the coating solution and drying it. The solvent is selected for improving dispersion in the solvent and for preventing the coating solution from gelation with the elapse of time. Further, the solvent may be used for preventing the composition of the coating solution from being changed as time passes, whereby storage stability of the coating solution can be improved and the coating solution can be reproduced.

The phrase "n-type" refers to materials which predominately transport electrons.

Typical n-type materials include dibromoanthanthrone, benzimidazole perylene, zinc oxide, titanium dioxide, azo compounds such as chlorodiane Blue and bisazo pigments, substituted 2,4-dibromotriazines, polynuclear aromatic quinones, zinc sulfide, and the like.

The phrase "p-type" refers to materials which transport holes. Typical p-type organic pigments include, for example, metal-free phthalocyanine, titanyl phthalocyanine, gallium phthalocyanine, hydroxy gallium phthalocyanine, chlorogallium phthalocyanine, copper phthalocyanine, and the like.

The n-type particles may have a grain shape. The grain shaped n-type particles have a particle size ranging for example from about 0.01 micrometer to about 1 micrometer as observed through a microscope, and a mean of the aspect ratio ranging from about 1 to about 1.3. The grain shaped n-type particles have an approximately spherical shape despite some degree of unevenness.

The n-type particles may have a needle-like shape (also referred herein as needle shaped). The term "needle-like" or "needle shaped" means a long and narrow shape including a stick and pole and it is a shape having an aspect ratio L/S of a length L of the long axis to a length S of the short axis of about 1.5 or more. It is not necessary to be extremely long and narrow or have a sharp pointed end. The mean of the aspect ratio is preferably in the range from about 1.5 to about 300, more preferably from about 2 to about 10. The short axis and long axis of the particle diameter of the needle-like particles are about 0.01 micrometer or less and about 100 micrometer or less, respectively, more preferably, about 0.05 micrometer or less and about 10 micrometer or less, respectively.

Such methods as natural sedimentation method and photo-extinction method and the like may be used for measuring the diameter and aspect ratio. Microscopic observation may be preferably used for measuring the diameter and aspect ratio of the needle shaped particles.

In the present invention, n-type particles can include a mixture of the needle-like particles and the grain shaped particles.

The solids content (i.e., all solids such as the binder and the n-type particles) of the charge blocking dispersion ranges for example from about 5% to about 60% by weight, based on the weight of the dispersion. The solvent, or a mixture of two or more solvents, may be present in an amount ranging from about 40% to about 95% by weight, based on the weight of the charge blocking dispersion. Suitable weight ratios of the components include the following: n-type particles to binder ratio ranging for example from about 90 (n-type particles)/10 (binder) to about 40 (n-type particles)/60 (binder), preferably from about 80/20 to about 50/50.

The n-type particles may be selected from metal oxides such as titanium dioxide, tin oxide, indium-doped tin oxide, antimony-doped tin oxide, and zinc oxide. The term "doped" means that the doped materials is incorporated into the crystals.

The n-type particles may be the n-type semiconductive organic pigments disclosed in Obinata et al., U.S. Pat. No. 5,928,824, the disclosure of which is totally incorporated herein by reference. Suitable organic materials include dichloro(phthalocyaninato)tin, chloro(phthalocyaninato) zinc, a perylene pigment, a quinone pigment, a squarylium pigment and an azo pigment. Quinophthalone pigment and many of the bisazo or trisazo pigments are examples of n-type organic pigments. A preferred organic material is benzimidazole perylene.

Preferred n-type particles are needle shaped and/or grain shaped titanium dioxide. Titanium dioxide has two crystal forms including anatase and rutile, both of which can be used for the present invention singly or in combination.

In embodiments, the needle-like particles have a volume resistance ranging for example from $10^5$ ohm-cm to $10^{10}$ ohm-cm under a loading pressure of 100 $Kg/cm^2$. Hereinafter, the volume resistance provided when the loading pressure of 100 $Kg/cm^2$ is applied is referred to simply as a powder resistance.

Besides, as long as the powder resistance of the needle-like particles preferably remain within the above scope, the surface of the needle-like particles may remain untreated or may be coated with $Al_2O_3$, $SiO_2$, ZnO and the like or the mixture thereof for improvement in dispersion properties and surface smoothness.

Since the needle-like particles have a long and narrow shape, the particles are easily in contact each other and the contact area between the particles is greater than that of grain-like particles alone. The electron transport through the blocking layer can then be improved by the better contacts between particles. Therefore, even with a smaller content of the needle-like particles in the blocking layer, a blocking layer having an equivalent properties can be easily produced. Employing a reduced amount of needle-like particles is advantageous for improving the film strength and adhesive properties with the conductive support. The properties of the photoreceptor containing the needle-like particles are not degraded after repeated use because the contact between the needle-like particles thereof are strong, whereby excellent stability is obtained.

The phenolic binder compositions (also referred herein as phenolic resins and the like) are preferably linear phenolic resins, prepared for example by condensation reaction of a mixture of un-substituted phenols and ortho or para substituted phenols with formaldehyde. The substitution can be for example any alkyl functional groups, for instance methyl, ethyl or t-butyl (preferably no phenols). Generally, phenols have 1 hydroxyl proton and 2 to 3 ortho/para aromatic protons (depending on the substitution) available for condensation reaction with the formaldehyde. The condensation reaction with the formaldehyde links the methyl groups or —$OCH_2$ groups through the ortho or para positions on the phenols or through the hydroxyl protons. The ortho and para positions are the more preferred linkage position than the hydroxyl due to the number of the available sites. Since the substitution on one of the phenols by the optional alkyl group, the available site for such a linkage is also limited. Consequently the alkyl substitutions on one of the phenols limit the branching of the resulting phenolic resin and the resulting phenolic resin is more linear with the predominate methyl linkage or —$OCH_2$ linkage. On the other hand, the phenolic resins prepared from mixtures of phenols and bisphenols are more branched. Bisphenols have 6 potential attachment sites for linkage (4 ortho aromatic protons and 2 hydroxyl protons). The linkage between phenols and bisphenols, or between bisphenols, is mostly through the hydroxyl group than through the ortho position. This is mainly due to the steric hindrance of the two phenol groups within the bisphenol units. Consequently, the resulting phenolic resin is more branched and has less hydroxyl groups.

The linearity of the phenolic resin and the number of available hydroxyl groups are important for dispersion stability of the n-type particles. The OH groups in the phenolic resins attach to the n-type particles to provide dispersability. Linear phenolic resin, as dissolved in the appropriate solvents, is flexible. The flexibility and the high number of hydroxyl groups allow more possibilities of the linear phenolic resin to attach to the n-type particles. The stronger attachment and the linearity of phenolic resin prevent the flocculation of the n-type particles. The more branched resins, in general, allow one phenolic polymer to attach to several n-type particles at close vicinity. The more branched phenolic resins, prepared from at least one bisphenol, also have weak attachment to the n-type particles due to less hydroxyl groups. The weak attachment at close vicinity is not strong enough to keep the n-type particles apart and flocculation can occur. The flocculation of the n-type particles cause particle settling, hence the dispersion is unstable.

In embodiments, the phenolic binder composition may include residual formaldehyde which remains from the reactions forming the phenolic polymers. The amount of the formaldehyde may be for example less than about 2,000 parts per million ("ppm"), preferably less than about 1,400 ppm, more preferably from about 200 ppm to about 1,400 ppm, and especially from about 400 ppm to about 1,200 ppm, in the phenolic binder composition. It may be possible to have a formaldehyde level outside the amounts described herein and still have a satisfactory charge blocking layer. In embodiments of the present invention, however, a formaldehyde level that is too high or too low may degrade the performance of the photoreceptor.

To reduce the formaldehyde level, the phenolic binder composition may be "aged" prior to its use in fabricating the charge blocking layer. Basically, aging the phenolic binder composition involves letting the material sit on the shelf undisturbed in a closed container at ambient conditions (i.e., about 25 degrees C) for a period of time ranging for example from about 3 weeks to about 12 months, preferably from about 1 month to about 6 months, and periodically determining the formaldehyde level until the desired level is reached. The desired formaldehyde level may be a value as described herein.

The Adhesive Layer

An intermediate layer 5 between the blocking layer and the charge generating layer may, if desired, be provided to promote adhesion. However, in the present invention, a dip coated aluminum drum may be utilized without an adhesive layer.

Additionally, adhesive layers can be provided, if necessary, between any of the layers in the photoreceptors to ensure adhesion of any adjacent layers. Alternatively, or in addition, adhesive material can be incorporated into one or both of the respective layers to be adhered. Such optional adhesive layers preferably have thicknesses of about 0.001 micrometer to about 0.2 micrometer. Such an adhesive layer can be applied, for example, by dissolving adhesive material in an appropriate solvent, applying by hand, spraying, dip coating, draw bar coating, gravure coating, silk screening, air knife coating, vacuum deposition, chemical treatment, roll coating, wire wound rod coating, and the like, and drying to remove the solvent. Suitable adhesives include, for example, film-forming polymers, such as polyester, dupont 49,000 (available from E. I. duPont de Nemours & Co.), Vitel PE-100 (available from Goodyear Tire and Rubber Co.), polyvinyl butyral, polyvinyl pyrrolidone, polyurethane, polymethyl methacrylate, and the like. The adhesive layer may be composed of a polyester with a $M_w$ of from about 50,000 to about 100,000, and preferably about 70,000, and a $M_n$ of preferably about 35,000.

The Imaging Layer(s)

The imaging layer refers to a layer or layers containing charge generating material, charge transport material, or both the charge generating material and the charge transport material.

Either a n-type or a p-type charge generating material can be employed in the present photoreceptor.

Illustrative organic photoconductive charge generating materials include azo pigments such as Sudan Red, Dian Blue, Janus Green B, and the like; quinone pigments such as Algol Yellow, Pyrene Quinone, Indanthrene Brilliant Violet RRP, and the like; quinocyanine pigments; perylene pigments such as benzimidazole perylene; indigo pigments such as indigo, thioindigo, and the like; bisbenzoimidazole pigments such as Indofast Orange, and the like; phthalocyanine pigments such as copper phthalocyanine, aluminochloro-phthalocyanine, hydroxygallium phthalocyanine, and the like; quinacridone pigments; or azulene compounds. Suitable inorganic photoconductive charge generating materials include for example cadium sulfide, cadmium sulfoselenide, cadmium selenide, crystalline and amorphous selenium, lead oxide and other chalcogenides. Alloys of selenium are encompassed by embodiments of the instant invention and include for instance selenium-arsenic, selenium-tellurium-arsenic, and selenium-tellurium.

Any suitable inactive resin binder material may be employed in the charge generating layer. Typical organic resinous binders include polycarbonates, acrylate polymers, methacrylate polymers, vinyl polymers, cellulose polymers, polyesters, polysiloxanes, polyamides, polyurethanes, epoxies, polyvinylacetals, and the like.

To create a dispersion useful as a coating composition, a solvent is used with the charge generating material. The solvent can be for example cyclohexanone, methyl ethyl ketone, tetrahydrofuran, alkyl acetate, and mixtures thereof. The alkyl acetate (such as butyl acetate and amyl acetate) can have from 3 to 5 carbon atoms in the alkyl group. The amount of solvent in the composition ranges for example from about 70% to about 98% by weight, based on the weight of the composition. The amount of the charge generating material in the composition ranges for example from about 0.5% to about 30% by weight, based on the weight of the composition including a solvent. The amount of photoconductive particles (i.e, the charge generating material) dispersed in a dried photoconductive coating varies to some extent with the specific photoconductive pigment particles selected. For example, when phthalocyanine organic pigments such as titanyl phthalocyanine and metal-free phthalocyanine are utilized, satisfactory results are achieved when the dried photoconductive coating comprises between about 30 percent by weight and about 90 percent by weight of all phthalocyanine pigments based on the total weight of the dried photoconductive coating. Since the photoconductive characteristics are affected by the relative amount of pigment per square centimeter coated, a lower pigment loading may be utilized if the dried photoconductive coating layer is thicker. Conversely, higher pigment loadings are desirable where the dried photoconductive layer is to be thinner.

Generally, satisfactory results are achieved with an average photoconductive particle size of less than about 0.6 micrometer when the photoconductive coating is applied by dip coating. Preferably, the average photoconductive particle size is less than about 0.4 micrometer. Preferably, the photoconductive particle size is also less than the thickness of the dried photoconductive coating in which it is dispersed.

In a charge generating layer, the weight ratio of the charge generating material ("CGM") to the binder ranges from 30 (CGM):70 (binder) to 70 (CGM):30 (binder).

For multilayered photoreceptors comprising a charge generating layer (also referred herein as a photoconductive layer) and a charge transport layer, satisfactory results may be achieved with a dried photoconductive layer coating thickness of between about 0.1 micrometer and about 10 micrometers. Preferably, the photoconductive layer thickness is between about 0.2 micrometer and about 4 micrometers. However, these thicknesses also depend upon the pigment loading. Thus, higher pigment loadings permit the use of thinner photoconductive coatings. Thicknesses outside these ranges can be selected providing the objectives of the present invention are achieved.

Any suitable technique may be utilized to disperse the photoconductive particles in the binder and solvent of the coating composition. Typical dispersion techniques include, for example, ball milling, roll milling, milling in vertical attritors, sand milling, and the like. Typical milling times using a ball roll mill is between about 4 and about 6 days.

Charge transport materials include an organic polymer or non-polymeric material capable of supporting the injection of photoexcited holes or transporting electrons from the photoconductive material and allowing the transport of these holes or electrons through the organic layer to selectively dissipate a surface charge. Illustrative charge transport materials include for example a positive hole transporting material selected from compounds having in the main chain or the side chain a polycyclic aromatic ring such as anthracene, pyrene, phenanthrene, coronene, and the like, or a nitrogen-containing hetero ring such as indole, carbazole, oxazole, isoxazole, thiazole, imidazole, pyrazole, oxadiazole, pyrazoline, thiadiazole, triazole, and hydrazone compounds. Typical hole transport materials include electron donor materials, such as carbazole; N-ethyl carbazole; N-isopropyl carbazole; N-phenyl carbazole; tetraphenylpyrene; 1-methyl pyrene; perylene; chrysene; anthracene; tetraphene; 2-phenyl naphthalene; azopyrene; 1-ethyl pyrene; acetyl pyrene; 2,3-benzochrysene; 2,4-benzopyrene; 1,4-bromopyrene; poly (N-vinylcarbazole); poly(vinylpyrene); poly(vinyltetraphene); poly(vinyltetracene) and poly (vinylperylene). Suitable electron transport materials include electron acceptors such as 2,4,7-trinitro-9-fluorenone; 2,4,5,7-tetranitro-fluorenone; dinitroanthracene; dinitroacridene; tetracyanopyrene; dinitroanthraquinone; and butylcarbonylfluorenemalononitrile, reference U.S. Pat. No. 4,921,769. Other hole transporting materials include arylamines described in U.S. Pat. No. 4,265,990, such as N,N'-diphenyl-N,N'-bis(alkylphenyl)-(1,1'-biphenyl)-4,4'-diamine wherein alkyl is selected from the group consisting of methyl, ethyl, propyl, butyl, hexyl, and the like. Other known charge transport layer molecules can be selected, reference for example U.S. Pat. Nos. 4,921,773 and 4,464,450.

Any suitable inactive resin binder may be employed in the charge transport layer. Typical inactive resin binders soluble in methylene chloride include polycarbonate resin, polyvinylcarbazole, polyester, polyarylate, polystyrene, polyacrylate, polyether, polysulfone, and the like. Molecular weights can vary from about 20,000 to about 1,500,000.

In a charge transport layer, the weight ratio of the charge transport material ("CTM") to the binder ranges from 30 (CTM):70 (binder) to 70 (CTM):30 (binder).

Any suitable technique may be utilized to apply the charge transport layer and the charge generating layer to the substrate. Typical coating techniques include dip coating, roll coating, spray coating, rotary atomizers, and the like. The coating techniques may use a wide concentration of solids. Preferably, the solids content is between about 2 percent by weight and 30 percent by weight based on the total weight of the dispersion. The expression "solids" refers to the photoconductive pigment particles and binder components of the charge generating coating dispersion and to the charge transport particles and binder components of the charge transport coating dispersion. These solids concentrations are useful in dip coating, roll, spray coating, and the like. Generally, a more concentrated coating dispersion is preferred for roll coating. Drying of the deposited coating may be effected by any suitable conventional technique such as oven drying, infra-red radiation drying, air drying and the like. Generally, the thickness of the charge generating layer ranges from about 0.1 micrometer to about 3 micrometers and the thickness of the transport layer is between about 5 micrometers to about 100 micrometers, but thicknesses outside these ranges can also be used. In general, the ratio of the thickness of the charge transport layer to the charge generating layer is preferably maintained from about 2:1 to 200:1 and in some instances as great as 400:1.

The materials and procedures described herein can be used to fabricate a single imaging layer type photoreceptor containing a binder, a charge generating material, and a charge transport material. For example, the solids content in the dispersion for the single imaging layer may range from about 2% to about 30% by weight, based on the weight of the dispersion. Where the imaging layer is a single layer combining the functions of the charge generating layer and the charge transport layer, illustrative amounts of the components contained therein are as follows: charge generating material (about 5% to about 40% by weight), charge transport material (about 20% to about 60% by weight), and binder (the balance of the imaging layer).

The Overcoating Layer

Embodiments in accordance with the present invention can, optionally, further include an overcoating layer or layers 8, which, if employed, are positioned over the charge generation layer or over the charge transport layer. This layer comprises organic polymers or inorganic polymers that are electrically insulating or slightly semi-conductive.

Such a protective overcoating layer includes a film forming resin binder optionally doped with a charge transport material.

Any suitable film-forming inactive resin binder can be employed in the overcoating layer of the present invention. For example, the film forming binder can be any of a number of resins, such as polycarbonates, polyarylates, polystyrene, polysulfone, polyphenylene sulfide, polyetherimide, polyphenylene vinylene, and polyacrylate. The resin binder used in the overcoating layer can be the same or different from the resin binder used in the anti-curl layer or in any charge transport layer that may be present. The binder resin should preferably have a Young's modulus greater than about $2\times10^5$ psi, a break elongation no less than 10%, and a glass transition temperature greater than about 150 degrees C. The binder may further be a blend of binders. The preferred polymeric film forming binders include MAKROLON™, a polycarbonate resin having a weight average molecular weight of about 50,000 to about 100,000 available from Farbenfabriken Bayer A. G., 4,4'-cyclohexylidene diphenyl polycarbonate, available from Mitsubishi Chemicals, high molecular weight LEXAN™ 135, available from the General Electric Company, ARDEL™ polyarylate D-100, available from Union Carbide, and polymer blends of MAKROLON™ and the copolyester VITEL™ PE-100 or VITELTM PE-200, available from Goodyear Tire and Rubber Co.

In embodiments, a range of about 1% by weight to about 10% by weight of the overcoating layer of VITEL™ copolymer is preferred in blending compositions, and, more preferably, about 3% by weight to about 7% by weight. Other polymers that can be used as resins in the overcoat layer include DUREL™ polyarylate from Celanese, polycarbonate copolymers LEXAN™ 3250, LEXAN™ PPC 4501, and LEXAN™ PPC 4701 from the General Electric Company, and CALIBRE™ from Dow.

Additives may be present in the overcoating layer in the range of about 0.5 to 0 about 40 weight percent of the overcoating layer. Preferred additives include organic and inorganic particles which can further improve the wear resistance and/or provide charge relaxation property. Preferred organic particles include Teflon powder, carbon black, and graphite particles. Preferred inorganic particles include insulating and semiconducting metal oxide particles such as silica, zinc oxide, tin oxide and the like. Another semiconducting additive is the oxidized oligomer salts as described in U.S. U.S. Pat. No. 5,853,906. The preferred oligomer salts are oxidized N, N, N', N'-tetra-p-tolyl-4,4'-biphenyldiamine salt.

The overcoating layer can be prepared by any suitable conventional technique and applied by any of a number of application methods. Typical application methods include, for example, hand coating, spray coating, web coating, dip coating and the like. Drying of the deposited coating can be effected by any suitable conventional techniques, such as oven drying, infrared radiation drying, air drying, and the like.

Overcoatings of from about 3 micrometers to about 7 micrometers are effective in preventing charge transport molecule leaching, crystallization, and charge transport layer cracking. Preferably, a layer having a thickness of from about 3 micrometers to about 5 micrometers is employed.

The Ground Strip

Ground strip 9 can comprise a film-forming binder and electrically conductive 16 particles. Cellulose may be used to disperse the conductive particles. Any suitable electrically conductive particles can be used in the electrically conductive ground strip layer 9. The ground strip 9 can, for example, comprise materials that include those enumerated in U.S. Pat. No. 4,664,995. Typical electrically conductive particles include, but are not limited to, carbon black, graphite, copper, silver, gold, nickel, tantalum, chromium, zirconium, vanadium, niobium, indium tin oxide, and the like.

The electrically conductive particles can have any suitable shape. Typical shapes include irregular, granular, spherical, elliptical, cubic, flake, filament, and the like. Preferably, the electrically conductive particles should have a particle size less than the thickness of the electrically conductive ground strip layer to avoid an electrically conductive ground strip layer having an excessively irregular outer surface. An average particle size of less than about 10 micrometers generally avoids excessive protrusion of the electrically conductive particles at the outer surface of the dried ground strip layer and ensures relatively uniform dispersion of the particles through the matrix of the dried ground strip layer. Concentration of the conductive particles to be used in the ground strip depends on factors such as the conductivity of the specific conductive materials utilized.

In embodiments, the ground strip layer may have a thickness of from about 7 micrometers to about 42 micrometers and, preferably, from about 14 micrometers to about 27 micrometers.

The invention will now be described in detail with respect to specific preferred embodiments thereof, it being understood that these examples are intended to be illustrative only and the invention is not intended to be limited to the materials, conditions, or process parameters recited herein. All percentages and parts are by weight unless otherwise indicated.

EXAMPLES

CDS Test for Examples

The CDS (charge deficient spot) level of the photoconductive imaging samples were evaluated in a modified printer (Epson LP8000SE) with the charging of the BCR (bias charge roll) and DR (development roll) supplied from the outside power supplies. The Voltage to the BCR was adjusted to be −700V ($V_h$). The voltage to the DR was adjusted to be 600V (Vbias). Both the modified printer and the test photoconductive imaging samples were conditioned in A zone (28 degrees C/85% relative humidity) for more than 24 hours before the test. The following test procedures were also performed in A zone. Then the imaging sample was mounted into the CRU and set into the printer. The printer was set at the desired $V_h$ and $V_{bias}$. Ten white prints were produced for CDS evaluation. The CDS level was determined by averaging the CDS counts measured from the ten prints. The CDS counts were the number of black spots of larger than 50 micrometer size, on the white prints of 10 inch by 10 inch area.

Example I

A charge blocking layer was fabricated from a coating dispersion, consisting of 80 weight percent of $TiO_2$ and 20 weight percent of phenolic binder composition. The charge blocking layer coating dispersion was prepared by dispersing 40 grams of generally spherical $TiO_2$ particles (MT500, available from Tayca Co.) into a solution of 10 grams linear phenolic binder composition, VARCUM® 29112 (available from OxyChem) dissolved in 50 grams of xylene and n-butanol solvent mixture at one to one weight ratio. This dispersion was milled in an attritor (Szegvari attritor system, available from Union Process Co.) with zirconium balls having a diameter of 0.4 millimeter for 4 hours. The average $TiO_2$ particle size in the dispersion solution was i measured to be 0.12 micrometer. The charge blocking layer was dip coated onto an aluminum drum substrate of 30 mm diameter and dried at a temperature of 150 degrees C for 30 minutes. The dried blocking layer coating was very uniform and clear. The dried blocking layer film has a thickness of about 3 micrometers. A charge generation coating dispersion was prepared by dispersing 22 grams of chloride gallium phthalylene particles having an average particle size of about 0.4 micrometers into a solution of 10 grams VMCH (available from Union Carbide Co.) dissolved in 368 grams of xylene and n-butanol solvent mixture at one to one weight ratio. VMCH was composed of 86% by weight vinyl chloride, 13% by weight vinyl acetate, and 1% by weight maleic acid, where the VMCH has a molecular weight of about 27,000. This dispersion was milled in a dynomill mill (KDL, available from GlenMill) with zirconium balls having a diameter of 0.4 millimeter for 4 hours. The drum with the charge blocking layer coating was dipped in the charge generation coating dispersion and withdrawn at a rate of 20 centimeters per minute. The resulting coated drum was air dried to form a 0.5 micrometer thick charge generating layer. a charge transport layer coating solution was prepared containing 40 grams of N,N'-diphenyl-N,N'-bis(3-methylphenyl)-(1,1'-biphenyl)-4,4'-diamine and 60 grams of poly(4,4'-diphenyl-1,1'-cyclohexane carbonate) (PCZ 400 available from Mitsubishi Chemical Co.) dissolved in a solvent mixture containing 80 grams of monochlorobenzene and 320 grams of tetrahydrofuran. The charge transport coating solution was applied onto the coated drum by dipping the drum into the charge transport coating solution and withdrawn at a rate of 150 centimeters per second. The coated drum was dried at 110° C. for 20 minutes to form a 20 micrometer thick charge transport layer. The resulting photoreceptor drum has CDS level of 36.

Comparative Example I

The process described in Example I was repeated except that the phenolic binder composition used for the charge blocking layer was different. A non-linear phenolic binder composition, VARCUM® 29108 (available from OxyChem) was used. VARCUM® 29108 was believed to have the following characteristics:

(A) A first repeat unit (10) was present in an amount ranging from about 20 to about 30 percent, calculated relative to the number of starting monomers (10)

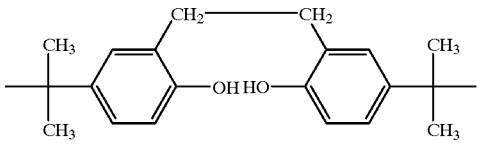

(B) A second repeat unit (11) was present in an amount ranging from about 60 to about 70 percent, calculated relative to the number of starting monomers (11)

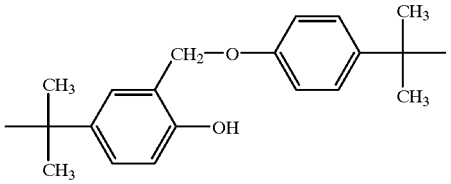

(C) A third repeat unit selected from the group consisting of two subtypes (12) and (13) was present in an amount ranging from about 20 to about 30 percent, calculated relative to the number of starting monomers, with up to half of the third repeat unit in certain embodiments being subtype (13)

(12)

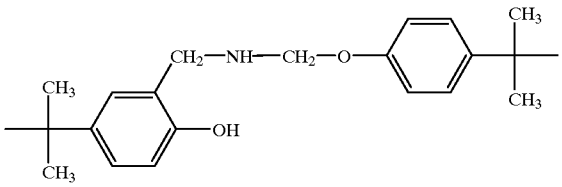

(13)

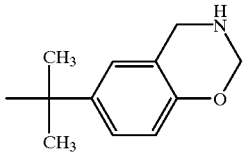

(D) About 10 percent of the binder composition could not be determined, calculated relative to the number of starting monomers;

(E) The linkage groups were $CH_2$ and/or $OCH_2$; and (F) Hexamethylenetetramine (1 percent) and propoxyethanol (6 percent) were present as residues, where the percentages of the residues were calculated relative to the number of starting monomers.

A polymerization process to prepare VARCUM® 29108 was believed to involve prepolymers crosslinked with hexamethylenetetramine. The starting bisphenol monomer was believed to be:

(16)

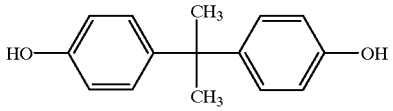

(100 mole percent).

The resulting $TiO_2$ particles in the charge blocking layer dispersion were large, average around 0.8 micrometer size. The particle size can not be reduced with the milling time longer than 4 hours. The $TiO_2$ particles settled quickly (within one day) in the dispersion solution. The coating of the charge blocking layer was very rough with streak patterns, not the smooth and clear coating obtained in Example I.

Comparative Example II

The process described in Example I was repeated except that the charge blocking layer solvents used were different. DOWANOL® (believed to contain propylene glycol monomethyl ether, available from Dow Chemical) and methanol at 2.5 to 1 weight ratio were used. The $TiO_2$ particles are around 0.2 micrometer size. The coating of the dispersion was not clear. Patterns of clear and hazy areas were detected on the coating, unlike the clear coatings shown in the Example I. Such a pattern was printed out in the gray area in the prints.

Example II

The process described in Example I was repeated except that the phenolic binder composition used for the charge blocking layer was different. A linear phenolic binder composition, DURITE® P97 (available from Borden Chemical) was used. The composition and manner of preparation of DURITE® P97 were believed to be the same as or similar to DURITE® ESD-556C described herein. The formaldehyde level in the DURITE® P97 was determined to be about 2122 ppm which was considered too high. DURITE® P97 was aged about 10 months at ambient conditions whereby the formaldehyde level dropped to about 882 ppm. The aged DURITE® P97 having the reduced formaldehyde level was then used in the fabrication of the charge blocking layer. The resulting charge blocking layer dispersion and coating quality were the same as the Example I. The resulting photoreceptor was tested for CDS level. The CDS level was 50.

Comparative Example III

The process described in Example II was repeated except that the the sample of DURITE® P97 was not aged. The formaldehyde level in this sample of the DURITE® P97 was 2494 ppm and this linear phenolic binder composition having the high formaldehyde level was then used in the fabrication of the charge blocking layer. The resulting photoreceptor was tested for CDS. The CDS level was 876, much higher than the result from the Example II. This level of CDS was unacceptable for high quality printer.

Other modifications of the present invention may occur to those skilled in the art based upon a reading of the present disclosure and these modifications are intended to be included within the scope of the present invention.

We claim:

1. A photoreceptor comprising:

(a) a substrate;

(b) a charge blocking layer including n-type particles and a phenolic binder composition including:

(i) a first type of repeat unit selected from the group consisting of the following three subtypes:

(1)

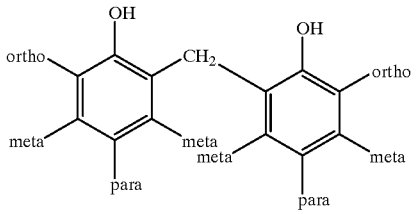

(2)

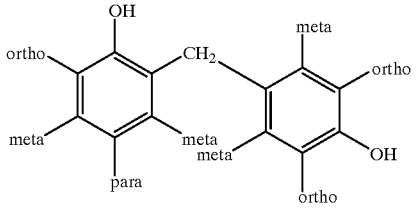

(3)

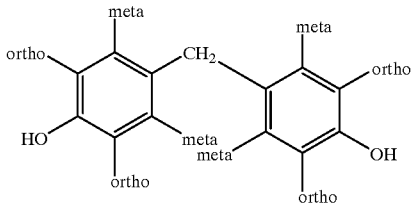

(ii) a second type of repeat unit of:

(4)

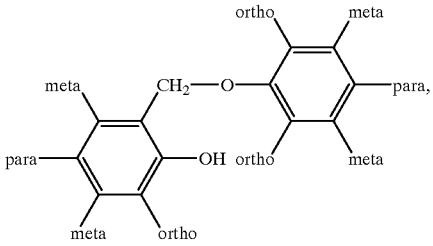

and (iii) a third type of repeat unit selected from the group consisting of the following two subtypes:

(5)

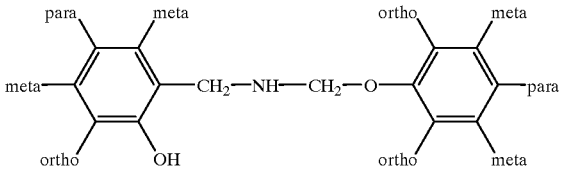

-continued (6)

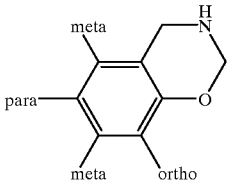

wherein the first repeat unit, the second repeat unit, and the third repeat unit all are present in the phenolic binder composition to form polymers including homopolymers of one type of repeat unit, copolymers of any two types of repeat units, or terpolymers of all three types of repeat units, or a mixture of any combination of the homopolymers, the copolymers, and the terpolymers, wherein the first repeat unit, the second repeat unit, and the third repeat unit form the polymers via linkage groups coupled to any of the ortho and para carbon atoms; wherein any combination of the three subtypes of the first repeat unit and a mixture of the two subtypes of the third repeat unit optionally are present in the homopolymers, the copolymers, and the terpolymers;

wherein at least one alkyl group having from I to 20 carbon atoms is optionally coupled to any of the ortho, meta, and para carbon atoms of the first repeat unit, the second repeat unit, and the third repeat unit which are not coupled to the linkage groups; and (c) an imaging layer.

2. The photoreceptor of claim 1, wherein the n-type particles are needle shaped particles.

3. The photoreceptor of claim 1, wherein the n-type particles are needle shaped titanium dioxide particles or grain shaped titanium dioxide particles.

4. The photoreceptor of claim 1, wherein the n-type particles are a metal oxide.

5. The photoreceptor of claim 1, wherein the alkyl group has from 1 to 5 carbon atoms.

6. The photoreceptor of claim 1, wherein the alkyl group is absent from the first repeat unit, the second repeat unit, and the third repeat unit.

7. The photoreceptor of claim 1, wherein the n-type particles and the phenolic binder composition have a weight ratio ranging from about 90 (the n-type particles)/10 (the phenolic binder composition) to about 40/60.

8. The photoreceptor of claim 1, wherein the n-type particles and the phenolic binder composition have a weight ratio ranging from about 80 (the n-type particles)/20 (the phenolic binder composition) to about 50/50.

9. The photoreceptor of claim 1, wherein the first repeat unit is present in an amount ranging from about 25 to about 60 mole percent, the second repeat unit is present in an amount ranging from about 10 to about 50 mole percent, and the third repeat unit is present in an amount ranging from about 10 to about 15 mole percent.

10. The photoreceptor of claim 1, wherein the image layer is a charge generating layer and the photoreceptor further comprises a charge transport layer.

11. The photoreceptor of claim 1, wherein the linkage groups are selected from the group consisting of $CH_2$ and $OCH_2$.

12. The photoreceptor of claim 1, wherein the phenolic binder composition further includes formaldehyde in an amount less than about 2,000 ppm.

13. The photoreceptor of claim 1, wherein the phenolic binder composition further includes formaldehyde in an amount less than about 1,400 ppm.

14. The photoreceptor of claim 1 wherein the phenolic binder composition further includes formaldehyde in an amount ranging from about 200 ppm to about 1,400 ppm.

* * * * *